US007234614B1

(12) United States Patent
Knight et al.

(10) Patent No.: US 7,234,614 B1
(45) Date of Patent: Jun. 26, 2007

(54) FUEL DISPENSING SPOUT WITH CONTINUOUS ENDFACE

(76) Inventors: Paul Allan Knight, 4127 S. Hatch St., Spokane, WA (US) 99203; Walt D Takisaki, 11910 E. 26th, Spokane, WA (US) 99206

( * ) Notice: Subject to any disclaimer, the term of this patent is extended or adjusted under 35 U.S.C. 154(b) by 472 days.

(21) Appl. No.: 10/733,920

(22) Filed: Dec. 11, 2003

(51) Int. Cl.
*B65D 5/72* (2006.01)

(52) U.S. Cl. ..... 222/566; 222/108; 222/568; 222/571; 141/311 A; 141/392; 137/312

(58) Field of Classification Search ..... 222/71, 222/108, 1, 566–568, 571; 141/311 A, 392; 137/312
See application file for complete search history.

(56) References Cited

U.S. PATENT DOCUMENTS

| | | | | |
|---|---|---|---|---|
| 2,686,626 | A | 8/1954 | Slattery | |
| 3,739,988 | A | 6/1973 | Kisor et al. | |
| 4,005,339 | A | 1/1977 | Plantard | |
| 4,213,488 | A | 7/1980 | Pyle | |
| 4,351,375 | A | 9/1982 | Polson | |
| 4,453,578 | A | 6/1984 | Wilder | |
| 4,682,714 | A | 7/1987 | Wood | |
| 5,004,023 | A | 4/1991 | Monticup, Jr. et al. | |
| 5,007,468 | A | 4/1991 | Wilder et al. | |
| 5,213,142 | A | 5/1993 | Koch et al. | |
| 5,255,723 | A | 10/1993 | Carmack et al. | |
| 5,267,670 | A | 12/1993 | Foster | |
| 5,327,945 | A * | 7/1994 | Simpson et al. | 141/59 |
| 5,450,884 | A | 9/1995 | Shih et al. | |
| 5,603,364 | A | 2/1997 | Kerssies | |
| 5,620,030 | A * | 4/1997 | Dalhart et al. | 141/206 |
| 5,620,031 | A * | 4/1997 | Dalhart et al. | 141/206 |
| 5,620,032 | A | 4/1997 | Dame | |
| 5,645,116 | A | 7/1997 | McDonald | |
| 5,765,609 | A * | 6/1998 | Dalhart et al. | 141/206 |
| 5,832,970 | A | 11/1998 | Carow | |
| 6,126,047 | A | 10/2000 | Johnson et al. | |
| 6,311,742 | B1 | 11/2001 | Nusen et al. | |
| 6,520,222 | B2 | 2/2003 | Carmack et al. | |
| 6,835,223 | B2 * | 12/2004 | Walker et al. | 55/385.1 |
| 6,983,772 | B1 * | 1/2006 | Lawrence et al. | 141/311 A |
| 7,036,536 | B1 * | 5/2006 | Knight et al. | 141/86 |
| 2003/0192429 | A1 * | 10/2003 | Walker et al. | 95/47 |

* cited by examiner

*Primary Examiner*—Frederick C. Nicolas

(57) ABSTRACT

The present invention therefore aims at providing a nozzle that reduces the amount of residual fuel left on a spout after fueling by encouraging the residual fuel to drip into the container to be filled. A fuel dispensing nozzle is comprised of a nozzle body, a fuel regulating valve, and a spout for directing the fuel supply from the regulating valve to and in the container to be filled. After a fueling cycle, fuel clings to both the inside and outside spout surfaces and can be considered a falling film. Wherein existing nozzle spouts have discontinuous spout end faces that impede the flow of falling films into the container to be filled, the improved nozzle and endface according to the present invention encourage the falling films to create drops that fall into a container to be filled.

6 Claims, 5 Drawing Sheets

FUEL DISPENSING SPOUT WITH CONTINUOUS ENDFACE

CROSS REFERENCE TO RELATED APPLICATION

There are no related applications.

STATEMENT REGARDING FEDERALLY SPONSORED R&D

Not applicable to this application.

TECHNICAL FIELD

This invention relates to a fuel nozzle and more particularly to a fuel dispensing nozzle that promotes residual fuel on the nozzle spout to drip into a container to be filled prior to the spout being removed from the container.

BACKGROUND OF THE INVENTION

Fuel dispensing nozzles are widely used and understood in the field. Fuel nozzles are used for directing and regulating a flow of fuel into a container to be filled. Typical fuel nozzles are comprised of a nozzle body, a valve assembly for regulating fuel flow, and a tubular spout.

Recently, significant attention has been directed to the adverse environmental effects caused by fuel dispensing nozzles. Fuel nozzles create vapors that contain volatile organics that chemically react with nitrogen oxides to form ground level ozone, often called "smog". Ground level ozone can potentially cause irritation to the nose, throat, lungs and bring on asthma attacks. In addition, fuel vapors contain other harmful toxic chemicals, such as benzene.

Fuel dispensing nozzles provide several significant sources of fuel vapors, including: vapors displaced from containers as liquid is inserted; fuel dripped from nozzle spouts; and, residual fuel left on spouts after a fueling cycle.

The most predominant source of fuel vapors has been addressed through the implementation of vapor recovery systems, such as described by U.S. Pat. No. 5,213,142. Typical vapor recovery systems dispense fuel though a main tube of a spout and vacuum vapors through a secondary spout channel. Although vapor recovery systems can significantly reduce the amount of vapors that reach the atmosphere, the technology is expensive to install and operate, and thus has been implemented in limited areas. In addition, vapor recovery systems do not address the sources of dripping fuel or residual fuel.

The issues of fuel dripping and residual fuel have largely been either ignored, or inadequately addressed by equipment manufacturers. To force manufacturers to develop technology that reduces these emissions, the California Air Resource Board (CARB) has implemented a series of new requirements that must be met by nozzle manufactures. The new requirements are implemented through a series of "Phases". One of the CARB requirements is that a fuel nozzle shall produce no more than one post fueling drop. Another requirement limits the amount of residual fuel that can be retained by a nozzle and hose assembly after fueling.

Many new drop reducing spouts have been created, such as: U.S. Pat. No. 5,602,364 and U.S. Pat. No. 5,645,116. Although these valve systems may reduce the amount of drops that occur, they are unlikely to consistently meet the requirements set forth by CARB. A problem with "dripless" technologies, such as listed above, is that they do not eliminate the drip creating residual fuel from the outside surfaces of the spout. In addition, the "dripless" features themselves have surfaces that can attract liquid fuel and increase the potential for drops. Many "dripless" spouts may eliminate unallowable drops in one test run, and then have one or more unallowable drops in subsequent test runs performed in the same fashion and with the same nozzle.

Another problem with existing nozzle technologies, such as described above, is that they do not typically work with existing "standard" (non-vapor recovery) type nozzles. These "standard" nozzles are used in a large percentage of fueling stations which are not located in highly populated areas or do not dispense large volumes of gasoline.

Yet another problem with existing nozzle technologies is that they require significant change-over costs. Many of the aforementioned designs require that at least a complete new nozzle be installed in order for their benefits to be realized.

In these respects, the improved nozzle endface surface according to the present invention substantially departs from conventional concepts of the prior art, and in doing so provide an apparatus primarily designed for the purpose of reducing the amount of vapor that reaches the atmosphere during a fueling cycle.

SUMMARY OF THE INVENTION

The present invention therefore aims at providing a nozzle that reduces the amount of residual fuel left on a spout after fueling by encouraging the residual fuel to drip into the container to be filled. A fuel dispensing nozzle is comprised of a nozzle body, a fuel regulating valve, and a spout for directing the fuel supply from the regulating valve to and in the container to be filled. After a fueling cycle, fuel clings to both the inside and outside spout surfaces and can be considered a falling film. Wherein existing nozzle spouts have discontinuous spout endfaces that impede the flow of falling films into the container to be filled, the improved nozzle and endface according to the present invention provides a nozzle spout that promotes fuel drops to form and fall into a container to be filled.

These and other features, aspects, and advantages of the present invention will become better understood with regard to the following description, appended claims, and accompanying drawings.

BRIEF DESCRIPTION OF THE DRAWINGS

Preferred embodiments of the invention are described below with the reference to the following accompanying drawings.

DETAILED DESCRIPTION OF THE PREFERRED EMBODIMENTS

Many of the fastening, connection, manufacturing and other means and components utilized in this invention are widely known and used in the field of the invention are described, and their exact nature or type is not necessary for a person of ordinary skill in the art or science to understand the invention; therefore they will not be discussed in detail.

As used herein, a reference with "'" (prime) indicates that the object is an improved object according to the present invention.

Applicant hereby incorporates by reference the following U.S. patents: U.S. Pat. No. 5,765,609 for an aluminum fuel spout construction; U.S. Pat. No. 5,603,364 for a "dripless" nozzle; U.S. Pat. No. 4,453,578 for a automatic shut-off nozzle; and, U.S. Pat. No. 5,213,142 for a vapor recovery system.

Figure 1:
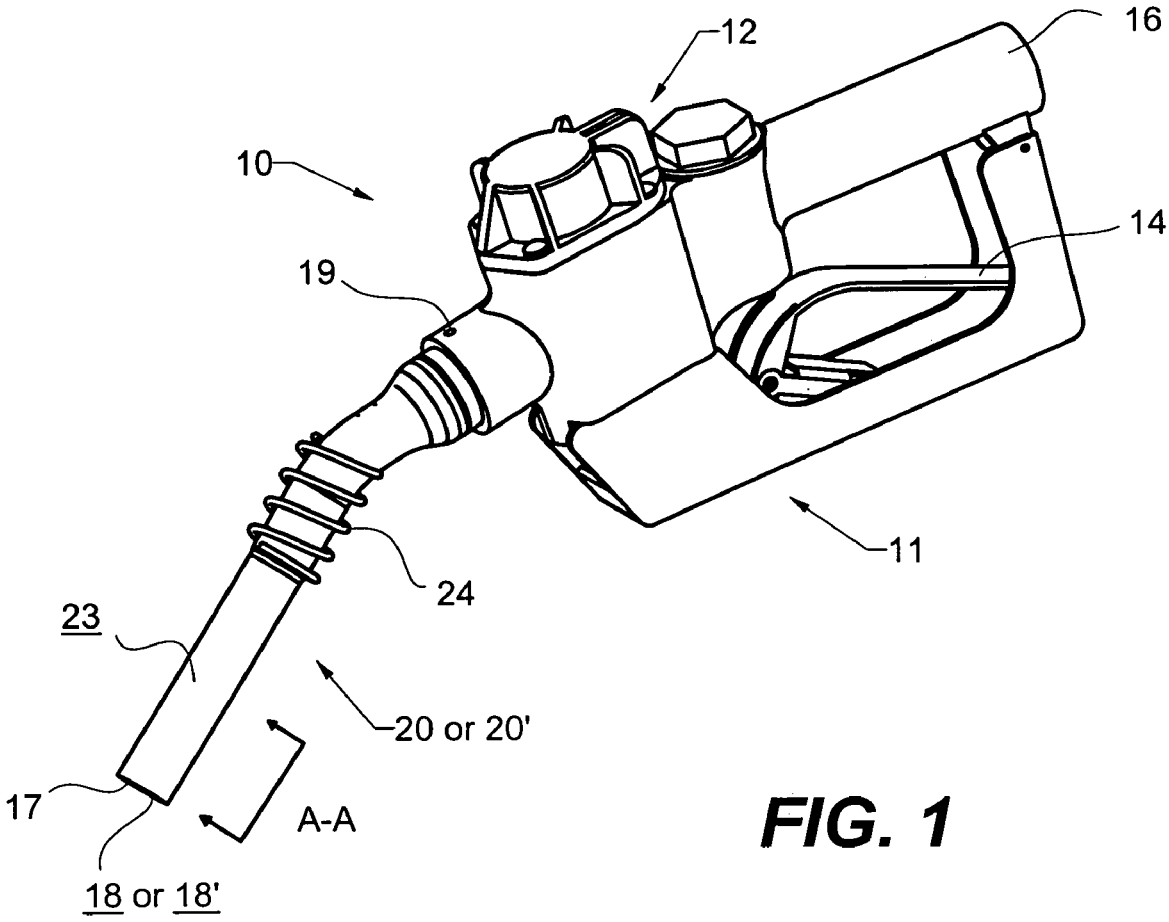
FIG. 1 is a perspective view of a standard nozzle assembly.
Figure 2:
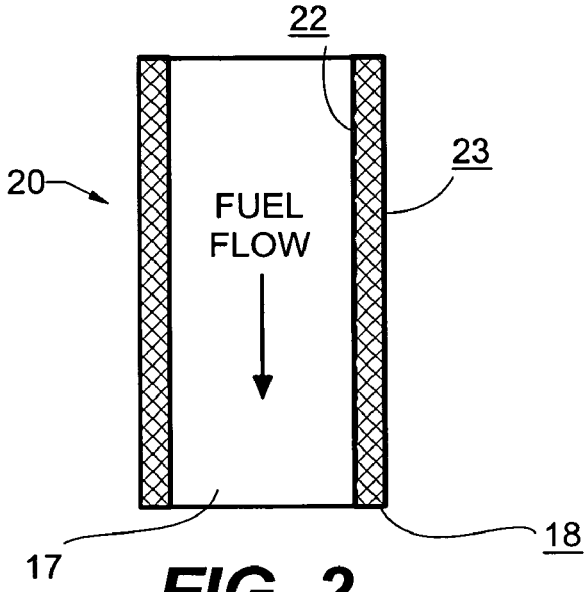
FIG. 2 (PRIOR ART)
FIG. 2 is a partial section view, along line A—A of FIG. 1, showing a prior art fuel dispensing spout with a square endface surface.

Referring now to the drawings, FIG. 1 shows a fuel dispensing nozzle assembly 10. Nozzle assembly 10 has an inlet end 16 for receiving a supply of liquid fuel from a hose and pump system (not shown). The flow of fuel is regulated by a valve assembly 12 and through the movement of an actuator 14. The flow of fuel travels from valve assembly 12, down the length of a spout 20, out a discharge end 17, and into a container to be filled (not shown). Spout 20 is used for directing the flow of fuel into the container to be filled. As show in FIG. 2, an inside spout surface 22 is in direct contact with the flow of fuel. Opposite of inside surface 22 is an exterior spout surface 23 (shown FIG. 2). Connecting inside surface 22 to outside surface 23 is an endface surface 18.

FIG. 1 shows a "standard" non-vapor recovery spout assembly 20, but spout 20 may be any one of the common vapor recovery types. Spout 20 may be removably attached to a nozzle body 11 by means of a spout screw 19. This allows spout 20 to be replaced without having to replace nozzle body 11.

Figure 3:
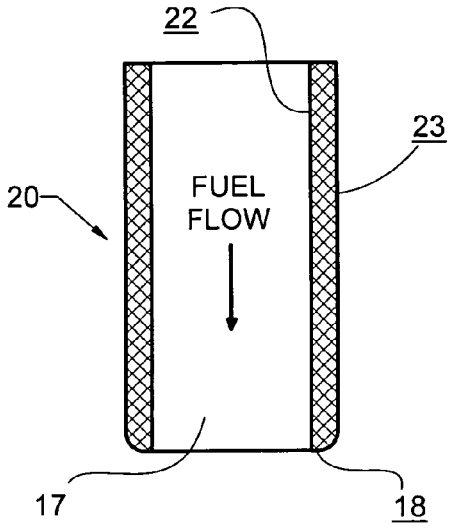
FIG. 3 (PRIOR ART)
FIG. 3 is a partial section view, along line A—A of FIG. 1, showing a prior art fuel dispensing spout with a "ramped" outside endface surface.

Spout 20 is typically made from extruded 6005-T5 aluminum. Aluminum provides a low cost, lightweight material that provides manufacturing process flexibility. U.S. Pat. No. 5,765,609 describes a process for making a low cost aluminum vapor recovery spout which has been incorporated herein by reference. Such a spout typically has a discontinuous endface surface 18 (shown in FIG. 2). Square shaped nozzles are a result of the spout being cut to length from an extrusion by means of a cutoff saw. Although square and stepped square endfaces are most common, some nozzles contain a discontinuous "conical ramp" as described by U.S. Pat. No. 5,765,609 (column 7, line 8). The "conical ramp" is for minimizing any sharp edge from being a hazard, or subject to abuse in use (also shown in FIG. 3 of this application). A sharp outside nozzle edge, as created by a cutoff saw, edge can potentially scratch car body finishes.

As part of the performance of nozzle assembly 10, the role of endface surface 18 can be much more significant than just not scratching a car's paint. An improved endface 18' of an improved spout 20' (shown in FIG. 5), according to the present invention, not only accomplishes the goals of the prior art, but it also significantly reduces the amount of fuel vapors that reach the atmosphere after a fueling cycle. Improved endface 18' accomplishes this by reducing the amount of liquid drops that reach the ground. Improved endface 18' also decreases the amount of residual fuel on improved spout 20', fuel that otherwise would evaporate into the atmosphere.

Figure 5:
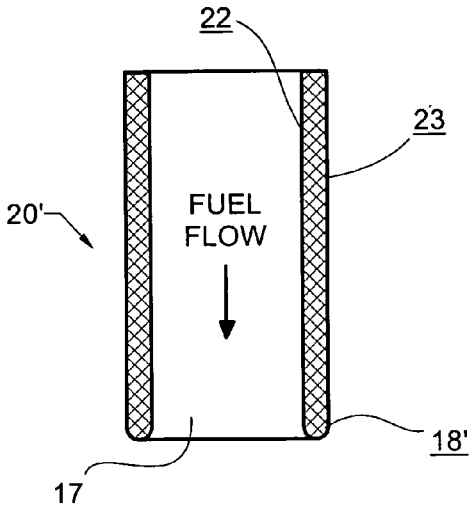
FIG. 5 is a partial section view, along line A—A of FIG. 1, showing an improved fuel dispensing spout according to the present invention.

Improved endface 18' according to the preferred embodiment of the present invention is shown in FIG. 5. Improved spout 20' is shown with inside surface 22 and outside surface 23. Adjacent to discharge end 17 is improved endface surface 18'. Endface surface 18' is generally radial and tangent to both inside surface 22 and outside surface 23. Improved endface surface 18' provides a smooth transition between inside surface 22 and outside surface 23 and the means for increasing the rate at which fuel drops fall from improved spout 20'. Endface 18' is preferred to have a radius generally equal to half the wall thickness of improved spout 20'.

When nozzle spout 20 and improved spout 20' dispenses fuel into a container to be filled, both inside surface 22 and outside surface 23 become wet with fuel. Inside surface 22 obviously wets because it directs and is in contact with the supply of fuel. Outside surface 23 becomes wet due to splashing within the container to be filled. Generally, outside surface 23 will collect less residual fuel than inside surface 22 due to a spring 24 that limits how far spout 20, or improved spout 20', can be inserted into the container to be filled.

After the flow of fuel through nozzle 10 is stopped (via deactivation of valve assembly 12), spout 20 and improved spout 20' have a thin fuel film located on both inside surface 22 and outside surface 23. This film, along with any trapped globules of fuel in close proximity to valve assembly 12, immediately begin to flow in the direction of discharge end 17 due to the influence of gravity.

Figure 4A:
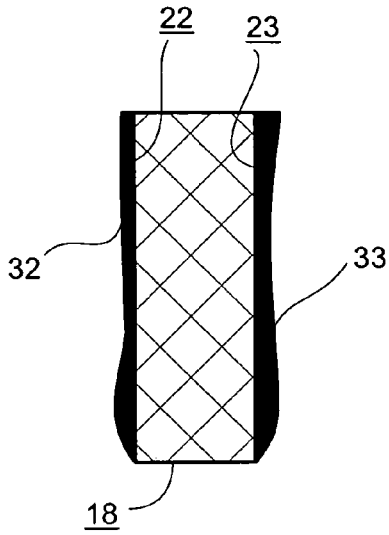
FIG. 4a (PRIOR ART)
FIG. 4*a* is partial view of the square endface surface of FIG. 2 soon after fuel flow stoppage.

FIG. 4*a* through FIG. 4*d* show how a fuel film flows under the influence of gravity with a prior art, square-shaped, endface surface 18. FIG. 4*a* shows a nozzle wall with inside surface 22 and outside surface 23 soon after fuel flow through nozzle 10 is stopped. An inside film 32 flows down inside surface 22 and an outside film 33 flows down outside surface 23. Both films, 32 and 33, travel in the direction of endface surface 18. Because square-shaped endface surface 18 is discontinuous with inside surface 22, and can be discontinuous with outside surface 23, inside film 32 and outside film 33 flow to and collect at the discontinuity (both surfaces are shown discontinuous in FIGS. 4*a* thru 4*d*).

Figure 4B:
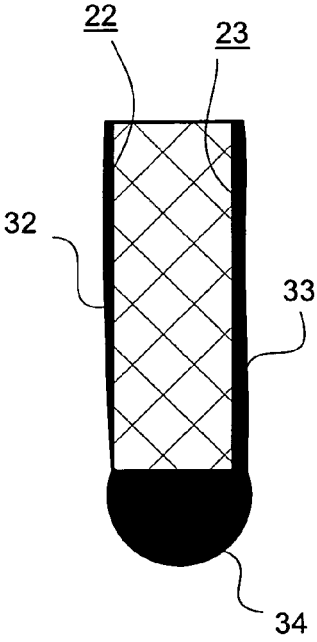
FIG. 4b (PRIOR ART)
FIG. 4*b* is a partial view of the endface surface of FIG. 2, at a time after that of FIG. 4*a*, and showing a drop starting to form about its square endface.

At some point in time after FIG. 4*a*, as shown in FIG. 4*b*, inside film 32 and outside film 33, have sufficient size and momentum to overcome any discontinuity between surface 18 and surfaces 22 or 23. The fuel that formerly collected at the discontinuity now clings to endface surface 18 due to adhesion between the fuel and the aluminum spout material. The fuel adhered to surface 18 forms a potential fuel drop 34.

Figure 4C:
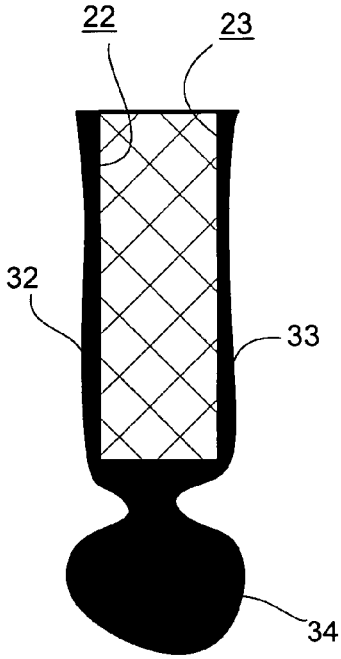
FIG. 4c (PRIOR ART)
FIG. 4*c* is a partial view of the endface surface of FIG. 2, at a time after that of FIG. 4*b*, with a drop just about to fall.

When fuel drop 34 becomes sufficient in size to cause necking, drop 34 soon falls in the direction of gravity. FIG. 4*c* shows drop 34 just prior to it breaking free of endface surface 18.

Figure 4D:
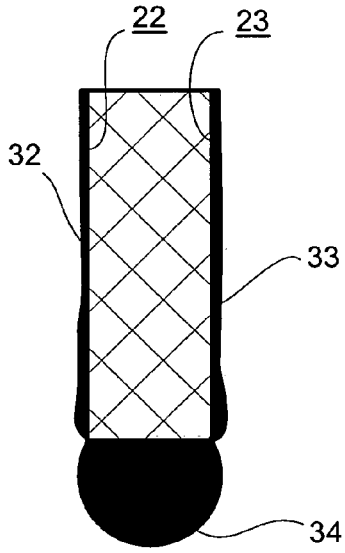
FIG. 4d (PRIOR ART)
FIG. 4*d* is a partial view of the endface surface of FIG. 2, at a time after that of FIG. 4*c*, and after the last drop has fallen.

The process of inside film 32 and/or outside film 33 creating drop 34 continues until an equilibrium is reached (shown in FIG. 4*d*). Equilibrium can occur from multiple events. One potential mode of equilibrium occurs when films 32 and 33 are too thin to overcome the discontinuities of surface 18. The result is a bulge of fluid between surfaces 22 and/or 23 and endface 18. Another equilibrium event occurs when film 32 and/or film 33 evaporates faster than its propensity to flow. This is likely to occur in very warm operating conditions. Lastly, equilibrium can occur when drop 34 is insufficient in size to cause necking.

As previously mentioned, improved endface surface 18', according to the present invention (shown in FIG. 5), is generally tangent to inside surface 22 and outside surface 23. FIGS. 6*a* through 6*d* show how the present invention increases the rate at which drips form (increases the chances the drips will remain in the tank) and reduces the amount of fuel remaining on the nozzle at equilibrium.

Figure 6A:
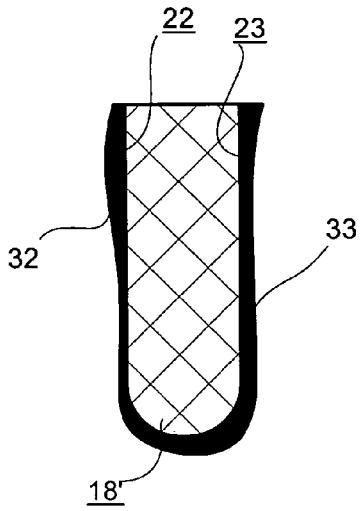
FIG. 6*a* is partial view of the improved endface of FIG. 5, according to the present invention, soon after fuel flow stoppage.

FIG. 6*a* shows a wall of improved spout 20' just after the flow of fuel through nozzle 10 is stopped. Again, inside surface 22 has an inside film 32 and outside surface 23 has a outside film 33. Because improved endface surface 18' is generally continuous to both surfaces 22 and 23, films 32 and 33 can immediately flow to improved endface surface 18' and start to form drop 34.

Figure 6B:
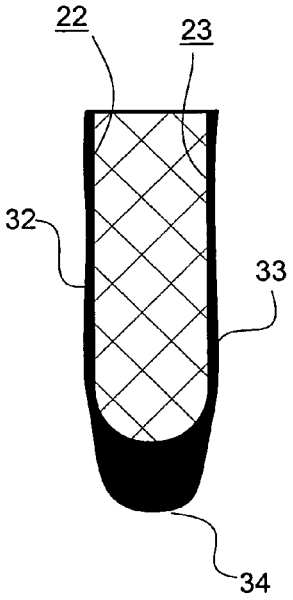
FIG. 6*b* is a partial view of the improved endface of FIG. 5, according to the present invention, at a time after that of FIG. 6*a*, and showing a drop starting to form about its round endface.
Figure 6C:
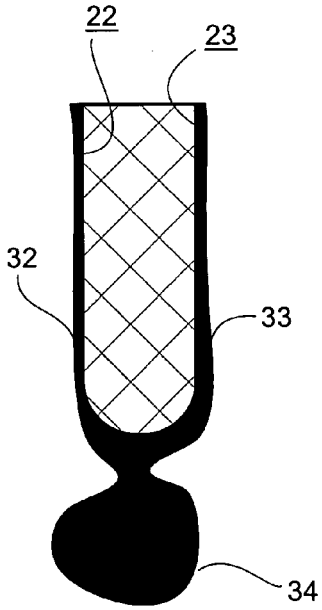
FIG. 6*c* is a partial view of the improved endface of FIG. 5, according to the present invention, at a time after that of FIG. 6*b*, with a drop just about to fall.
Figure 6D:
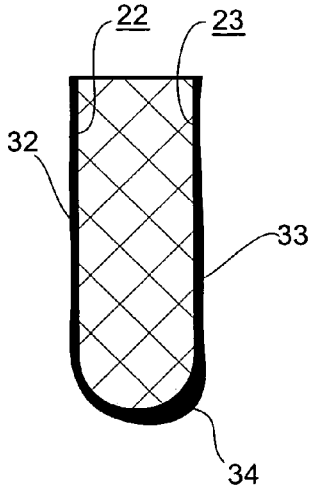
FIG. 6*d* is a partial view of the improved endface of FIG. 5, according to the present invention, at a time after that of FIG. 6*c*, after the last drop has fallen.

FIG. 6*b* shows how the momentum of films 32 and 33 add to the movement of drop 34 in the direction of gravity. FIG. 6*c* shows how drop 34 necks down in close proximity to improved surface 18' thus allowing drop 34 to fall in the direction of gravity. FIG. 6*d* shows an equilibrium condition for improved spout 20'. The randomness of equilibrium is reduced by the improved spout 20' over that of prior art spout 20. Randomness is reduced because the falling fuel film is unable to collect at a discontinuity; one does not exist.

Overall, improved endface surface 18' significantly increases the rate at which dripping occurs. This acceleration of dripping significantly increases the number of drops that occur within the time that a user would shut off the flow of fuel through a nozzle and the time at which the user removes the nozzle from the container to be filled. The result is more residual fuel dripping into the container to be filled, rather than evaporating into the atmosphere or dripping onto the ground. The method of promoting dripping is a dramatic shift from the prior art practices of trying to resist dripping.

The test results of FIG. 12 show the significant improvements of improved endface surface 18' of the present invention over endface surface 18 of the prior art. Many more drops fell with the present invention prior to the end of a 5 second time period. This measured improvement is well before the allocated 10 second wait period provided by CARB test procedures. Because more drops fall sooner, less fuel ends up on the ground or left on the nozzle spout.

Although the present invention does not provide "dripless" performance, the improvements of the technology can be added to existing designs for improved performance and at a low cost. The present invention can be applied to standard nozzles, vapor recovery nozzles and "dripless" nozzles. Wherein millions of automobile tanks are fueled every day, the present invention creates an opportunity for significant environmental savings.

Figure 7:
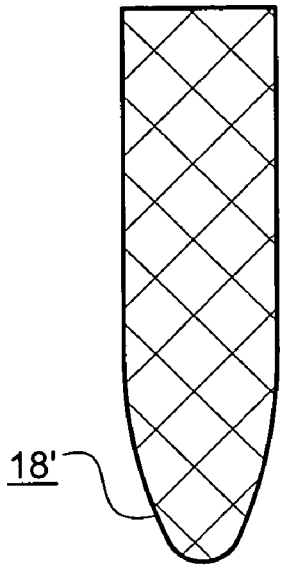
FIG. 7 is a partial section view of a spout endface according to an alternative embodiment of the present invention.
Figure 8:
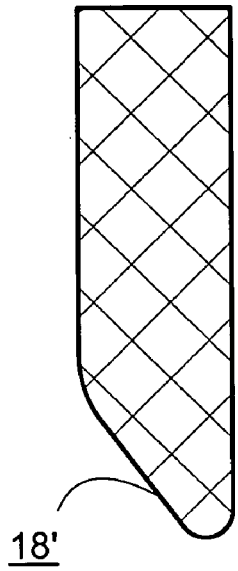
FIG. 8 is a partial section view of an alternative embodiment spout endface.
Figure 9:
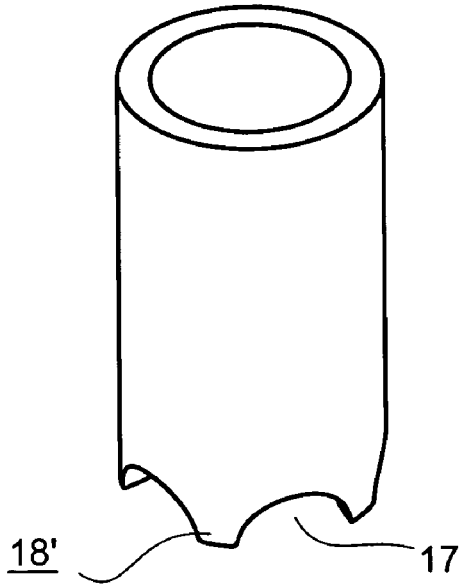
FIG. 9 is a partial perspective view of a nozzle discharge end with an alternative embodiment endface surface.
Figure 10:
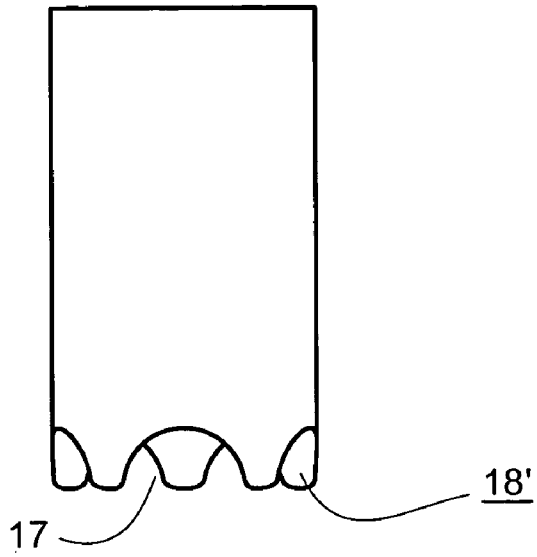
FIG. 10 is a partial side view of the alternative embodiment of the present invention shown in FIG. 9.
Figure 11:
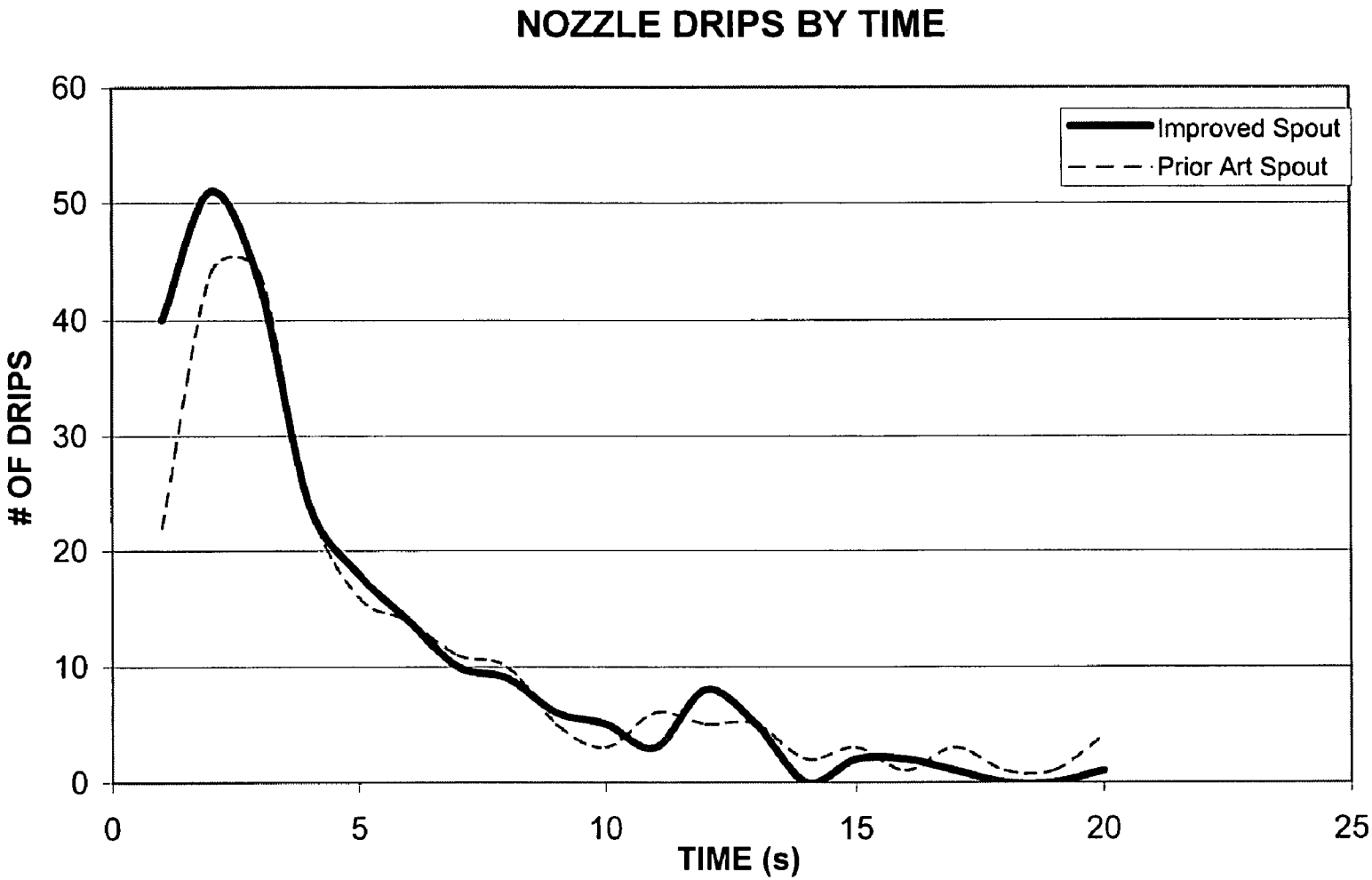
FIG. 11 is a plot showing the improved performance of the present invention in comparison to the prior art.

Other embodiments of the present invention are possible. FIG. 7 shows an elliptically curved improved endface surface 18'. FIG. 8 shows an offset endface surface 18' wherein the curve of surface 18' is biased in one direction or the other and still remains generally tangent to both surfaces of the spout. FIGS. 9 and 10 show yet another alternative embodiment of the present invention wherein the creation of drops is encouraged by improved endface surface 18' having one or more protrusions in the axial direction of spout 20. The axial protrusions provide the means of increasing the rate at which fuel drops fall from spout 20 by focusing the falling films into drip locations. The axial protrusions can be radial, as shown, triangular, or elliptical and the such.

Operating the improved spout 20' according to the present invention is unchanged from the prior art. The user inserts improved spout 20' into the container to be filled and actuates the flow of fuel through nozzle body 11. When the fluid reaches the desired level, the flow of fuel stops and the user removes improved spout 20' from the container to be filled. The result, is a transparent method of reducing the amount of harmful vapors emitted into the atmosphere during the fueling cycle.

Improved endface surface 18' can be manufactured into new nozzles via a number of widely known metal manufacturing processes. In addition, improved endface 18' may also be re-manufactured into existing nozzles by either refurbishing the nozzles or by reworking on site. Another method of practicing the present invention is to insert a secondary tip into an existing spout. Yet another method is to manufactur the present invention into an inside fill tube, as sometimes used with vapor recover systems.

While the low liquid retention fuel nozzle systems herein described constitute preferred embodiments of the invention, it is to be understood that the invention is not limited to these precise form of assemblies, and that changes may be made therein without departing from the scope and spirit of the invention as defined in the appended claims.

We claim:

1. A fuel dispensing nozzle comprising:

a generally tubular spout attached to said nozzle for directing a fuel supply from a valve within said nozzle to a discharge end of said spout;

an inside surface of said spout in direct contact with said fuel supply;

an outside surface of said spout opposite of said inside surface;

an endface surface of said spout, said endface surface creating a curved and continuous connection between both said inside surface and said outside surface of said spout; and, wherein said endface surface includes one or more axial protrusions.

2. The fuel dispensing nozzle of claim 1, wherein said endface surface is radial.

3. The fuel dispensing nozzle of claim 1, wherein said endface surface is elliptical.

4. The fuel dispensing nozzle of claim 1, wherein said endface surface is biased towards either said outside surface or said inside surface.

5. The fuel dispensing nozzle of claim 1, wherein said nozzle is a vapor recovery nozzle.

6. The fuel dispensing nozzle of claim 1, wherein said nozzle is a standard type nozzle.

* * * * *